US006270198B1

(12) United States Patent
Ahn et al.

(10) Patent No.: US 6,270,198 B1
(45) Date of Patent: Aug. 7, 2001

(54) MICRO INJECTING DEVICE

(75) Inventors: Byung-sun Ahn, Suwon (KR); Lavrishev Vadim Chetrovich, Moscowskaya oblast; Dunaev Boris Nikolaevich, Moscow, both of (RU)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/432,611

(22) Filed: Nov. 3, 1999

(30) Foreign Application Priority Data

Nov. 3, 1998 (RU) ..... 98119889

(51) Int. Cl.[7] ..... B41J 2/05; B41J 2/175
(52) U.S. Cl. ..... 347/63; 347/65; 347/93
(58) Field of Search ..... 347/63–65, 67, 347/93, 94

(56) References Cited

U.S. PATENT DOCUMENTS

| | | | | |
|---|---|---|---|---|
| 4,480,259 | * | 10/1984 | Kruger et al. | 347/63 |
| 4,490,728 | | 12/1984 | Vaught et al. | 347/60 |
| 4,809,428 | | 3/1989 | Aden et al. | 29/611 |
| 5,140,345 | | 8/1992 | Komuro | 347/64 |
| 5,274,400 | | 12/1993 | Johnson et al. | 347/43 |
| 5,420,627 | | 5/1995 | Keefe et al. | 347/87 |
| 5,648,805 | * | 7/1997 | Keefe et al. | 347/65 |
| 6,007,188 | * | 12/1999 | MacLeod et al. | 347/65 |

* cited by examiner

*Primary Examiner*—John Barlow
*Assistant Examiner*—Juanita Stephens
(74) *Attorney, Agent, or Firm*—Robert E. Bushnell, Esq.

(57) ABSTRACT

The present invention relates to a micro-injecting device for supplying working fluid for heating chambers. According to an embodiment of the present invention, two main channels for supplying the working fluid for the heating chamber are formed in the micro-injecting device. Even if one of the main channels is prevented by means of dust or particle, or due to a defect of etching, it can be possible to supply the working fluid for the heating chambers as supply of the working fluid can be accomplished through the other channel communicated with one of channels. In the embodiment of the present invention, furthermore, in order to increase flow resistance of the working fluid, a feeder channel for supplying the working fluid for the heating chambers can be formed in a curved shape or a plurality of projections can be formed on the outer walls of heating chamber barrier layers defining the auxiliary channel for supplying the working fluid for the heating chambers. Accordingly, it can be possible to prevent backwash of the working fluid, assuring uniform operation of the membranes.

20 Claims, 6 Drawing Sheets

MICRO INJECTING DEVICE

CLAIM OF PRIORITY

This application makes reference to, incorporates the same herein, and claims all benefits accruing under 35 U.S.C. §119 from an application for MICRO INJECTING DEVICE earlier filed in the Russian Patent Office on the Nov. 3, 1998 and there duly assigned Ser. No. 98119889.

BACKGROUND OF THE INVENTION

1. Field of the Invention

The present invention relates to the field of micro-injecting devices and ink jet print heads, particularly to membrane-type micro-injecting devices, and more particularly to the channel arrays for supplying working fluid in the devices.

2. Description of the Prior Art

Micro-injecting devices are able to discharge liquids of a variety of colors by using cartridges. Among the advantages of these devices is low noise. Also, there is an advantage when used in an ink-jet printer that letters printed on paper are fine and clear. As a result, the use of the ink-jet printers has been increasing.

A printer head is mounted in the ink-jet printer. The printer head sprays ink outward after transforming and expanding the ink in a bubble according to electric signals from outside of the printer, thereby carrying out the operation of printing letters on a paper.

Examples of the construction and operation of several ink jet print heads of the conventional art are seen in the following U.S. Patents. U.S. Pat. No. 4,490,728, to Vaught et al., entitled Thermal Ink Jet Printer, describes a basic print head. U.S. Pat. No. 4,809,428, to Aden et al., entitled Thin Film Device For An Ink Jet Printhead and Process For Manufacturing Same and U.S. Pat. No. 5,140,345, to Komuro, entitled Method Of Manufacturing a Substrate For A Liquid Jet Recording Head And Substrate Manufactured By The Method, describe manufacturing methods for ink-jet printheads. U.S. Pat. No. 5,274,400, to Johnson et al., entitled Ink Path Geometry For High Temperature Operation Of Ink-Jet Printheads, describes altering the dimensions of the ink-jet feed channel to provide fluidic drag. U.S. Pat. No. 5,420,627, to Keefe et al, entitled Ink Jet Printhead, shows a particular printhead design.

Generally, these micro injecting devices use high temperature of heat generated by a heating layer within the device to spray the ink on the paper. Accordingly, the high temperature which is generated by the heating layer has an effect on ink contained in an ink chamber for a long time. As a result, the ink is thermally transformed and this causes the durability of the apparatus containing the ink to decrease rapidly.

Recently, to overcome this problem, there has been proposed a new method for smoothly spraying ink from the ink chamber toward the outside by disposing a plate membrane between the heating layer and the ink chamber and inducing a dynamic deformation of the membrane under a pressure of a working fluid, for example, heptane. Since the membrane is disposed between the ink chamber and the heating layer, preventing the ink from contacting directly to the heating layer, the ink itself is subjected to little thermal transformation. An example of this type of printhead is seen in U.S. Pat. No. 4,480,259, to Kruger et al., entitled Ink Jet Printer With Bubble Driven Flexible Membrane.

In ink-jet printer heads of the conventional art using this method, the working fluid, which is supplied into an inlet of the printer head, flows along the main channel for supplying the working fluid, which is defined by means of barrier layers of the heating chamber. Then, the working fluid branches out from the main channel for supplying the working fluid and flows along a feeder channel for supplying the working fluid. At the end of the channel, the working fluid fills up the heating chamber.

The main channel and feeder channel for supplying the working fluid are formed by etching the barrier layer while the heating chamber is formed from the barrier layer. However, when the barrier layer is not etched sufficiently, such that the channel for supplying the working fluid is blocked by the barrier layer of the heating chamber, the working fluid which is introduced into the inlet of the print head cannot flow toward the heating chamber. As a result, the heating chamber is not filled with the working fluid.

Furthermore, when a foreign substance, such as dust or other particle, is introduced into the channel for supplying the working fluid during the process of the etching, thus obstructing a pathway of the working fluid, the working fluid cannot flow toward the heating chamber, as described above. As a result, the heating chamber is not filled with the working fluid.

When the heating chamber is not sufficiently supplied with working fluid because the barrier layer obstructs the pathway of the working fluid, the membrane which is operated by relying on the pressure of the working fluid cannot carry out its function. Accordingly, the printer head does not operate properly.

As described above, the working fluid which is supplied through the inlet of the printer head fills the heating chamber through each channel for supplying the working fluid. As the pressure in the heating chamber is increased by heating from the heating layer, the working fluid introduced into the heating chamber backs up under the pressure and flows along the feeder channel in reverse direction, this backwash resulting in the working fluid being introduced into the adjacent heating chambers. In the case described above, the working fluid is oversupplied for the adjacent heating chambers, while the heating chamber from which the working fluid backwash occurs is subjected to a lack of the working fluid. Therefore, the heating chamber in which the working fluid is oversupplied has a working fluid pressure higher than the desired pressure, while the heating chamber with a lack of the working fluid due to the backwash has a working fluid pressure lower than the desired pressure.

Accordingly, the membranes, which are activated by relying on the pressure of the working fluid, cannot be operated uniformly in their respective heating chambers. The net effect of this phenomenon is that the amount of the ink which is finally sprayed from a respective nozzle is not regular, thereby markedly degrading the quality of printing.

SUMMARY OF THE INVENTION

It is therefore an object of the present invention to provide an improved micro-injecting device or ink-jet print head.

It is a further object of the invention to provide an ink-jet print head which has improved reliability.

It is a yet further object of the invention to provide an ink-jet print head with improved quality of printing.

It is a still further object of the present invention to provide an ink-jet print head with improved uniformity of ink spraying.

It is a still yet further object to provide a membrane-type ink-jet print head which is less susceptible to manufacturing defects in the working fluid supply channels or to particles in the working fluid.

It is another object to provide a membrane-type ink-jet print head in which the working fluid is provided to the heating chambers even if a pathway for the working fluid is obstructed.

It is yet another object to provide a membrane-type ink-jet print head in which the pressure loss due to backwash of the working fluid out of the heating chamber is reduced.

It is still another object to provide a membrane-type ink-jet print head in which backwash of the working fluid from one heating chamber into another is reduced.

The present invention has been made to overcome the above-described problems of the prior art. To accomplish the objects of the present invention, there is provided a printer head having two main channels for supplying working fluid which are communicated with an inlet thereof for introducing the working fluid therein, wherein one of main channels for supplying the working fluid is branched in order to dispose a plurality of feeder channels for supplying the working fluid which are connected to heating chambers.

The main channels for supplying the working fluid communicate with each other through a plurality of connecting channels. Even if one of the two main channels for supplying the working fluid for the heating chambers is obstructed by means of dust or particles or due to a defect of etching, the working fluid can flow through the other channel communicating with one channel for supplying the working fluid for the heating chambers.

Preferably, the feeder channel for supplying the working fluid to the heating chambers has a curved shape in the plane of the channel so as to provide a substantial flow resistance of the working fluid. In this case, the working fluid which fills the heating chambers closely contacts the barrier layers defining the feeder channel for supplying the working fluid for the heating chambers so as not to back up toward the adjacent heating chamber.

More preferably, a plurality of projections are formed on outer walls of the liquid chamber barrier layer defining the feeder channel for supplying the working fluid for the heating chambers in order to increase the flow resistance of the working fluid. In this case as well, the working fluid which fills the heating chambers comes in close contact with the projections so as not to back up toward the adjacent heating chambers.

The present invention accordingly improves the overall quality of the printing by an ink-jet printhead.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, a channel array of a ink-jet printer head according to a preferred embodiment of the present invention will be described in detail with reference to the accompanying drawings.

Figure 1:
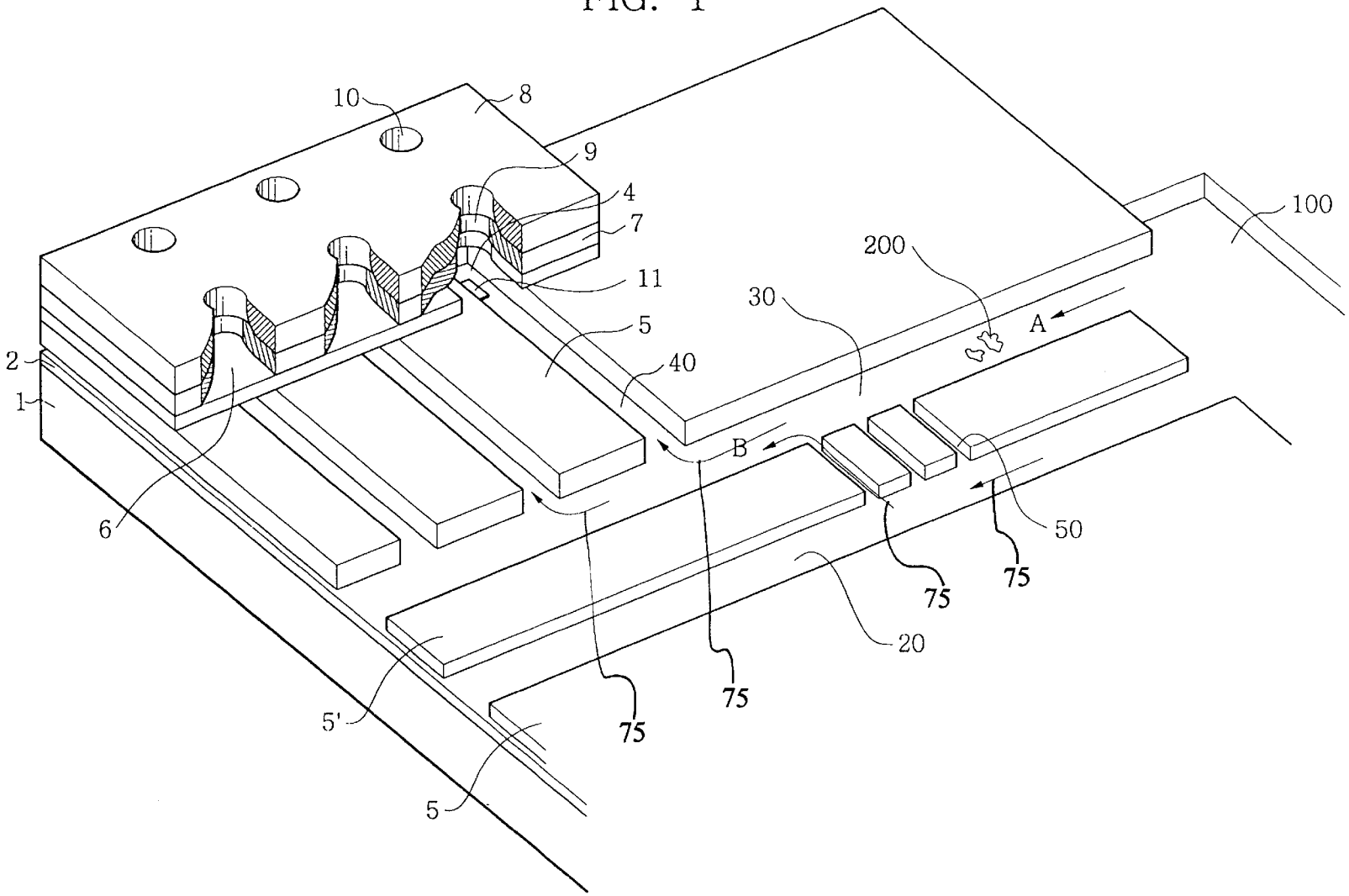
FIG. 1 is a perspective view of a channel array of an ink-jet printer head for supplying working fluid for heating chambers according to the first embodiment of the present invention.

As shown in FIG. 1, in an ink-printer head having a channel array for supplying the working fluid for the heating chamber according to the present invention, a protective film 2 is disposed to adhere to an upper surface of a base 1. Base 1 may be made of silicon and protective film 2 may be made of $SiO_2$. A heating layer 11 is disposed in place on an upper surface of the protective film 2. Electric energy may be applied from an external electric source (not shown) so as to heat the heating layer 11. An electrode layer (not shown) is disposed on an edge portion of the heating layer 11, which supplies the electric energy for the heating layer 11 from the external electric source. The electric energy which is supplied from the electrode layer for heating layer 11 is transformed into heat energy of high temperature by means of the heating layer 11.

Furthermore, a heating chamber 4 is defined by means of a barrier layer 5 over the electrode layer so as to cover the heating layer 11. Heat which is generated by the heating layer 11 is transmitted into the heating chamber 4.

The heating chamber 4 is filled with a working fluid which readily generates a vapor pressure. The working fluid is rapidly evaporated by the heat transmitted from the heating layer 11. In the process, the vapor pressure which is generated due to the evaporation of the working fluid is applied to a membrane 6 formed on the barrier layer 5.

An ink chamber, or liquid chamber, 9 is defined by an ink chamber barrier layer, or liquid chamber barrier layer, 7 over the membrane 6 so as to be coaxial with the heating chamber 4. The ink chamber 9 is filled with a predetermined quantity of ink.

Apertures are perforated in nozzle plate 8 to form nozzles 10, corresponding to the ink chambers 9, respectively, nozzles 10 being for discharging the ink to the outside. These nozzles 10 are formed through the nozzle plate 8 to be coaxial with the heating chambers 4 and the ink chambers 9.

In the ink-jet printer head as constructed and described above, a first channel, or primary channel, 30 and second channel, or auxiliary channel, 20 for supplying the working fluid for the heating chambers 4 are defined near to the heating chambers 4 by the barrier layer 5 which defines the heating chambers 4. The first and second channels communicate with an inlet 100 for introducing the working fluid into the printer head. The first channel 30 and the second channel 20 for supplying the working fluid for the heating chambers 4 are used as the main supplying pathways when the working fluid is supplied for the heating chambers 4. The introducing inlet 100 comes in tight connection with an introducing tube of a tool which is disposed in a cartridge and used for pouring the working fluid so as to act as a gate to transmit the working fluid supplied from the ink cartridge toward the heating chamber 4 of the ink-jet printer head.

The first, or primary, channel 30 for supplying the working fluid for the heating chambers 4 is branched to a plurality of third, or feeder, channels 40 for supplying the working fluid, which are defined by means of the heating chamber barrier layer 5. The third channels 40 respectively connect the first channels 30 to the heating chambers 4 corresponding to the first channels 30 so that the first channels 30 respectively communicate with each of the heating chamber 4.

Accordingly, the working fluid flowing along the first channel 30 branches into each of the third channels 40 to be supplied to each of the heating chamber 4. The third channels 40 are made to have a width narrower than those of the first channel 30 and the second channel 20 in order to increase flow rate of the working fluid.

On the other hand, the first channel 30 for supplying the working fluid for the heating chambers 4 is separated by means of a heating chamber barrier layer 5' from the second channel 20 for supplying the working fluid for the heating chambers 4. Fourth channels, or cross-channels, 50 are formed in the heating chamber barrier layer 5' so as to connect the first channel 30 with the second channel 20, as shown in FIGS. 1 to 5. The fourth channels 50 are used as pathways which connect the first channel 30 with the second channel 20. The working fluid which is supplied through the introducing inlet 100 from the ink cartridge can flow through the cross-channels 50 from the first channel 30 to the second channel 20 or from the second channel 20 to the first channel 30.

Even if the first channel 30 is partially obstructed by dust or particles or due to a defect of the etching during the manufacturing of the printer head, the working fluid which flows along the second channel 20 moves through the fourth channels 50 toward the first channel 30, which in turn is branched to each of the third channels 40 before being supplied to the heating chambers 4.

When, for example, particles 200 are present in a region A of the first channel 30 so that the pathway of the working fluid which flows along the first channel 30 is obstructed by the particles 200, the working fluid which flows along the second channel 20 moves through the fourth channels 50 toward a region B spaced apart from the region A of the first channel 30, which in turn is branched to each third channel 40, as shown by arrows 75. Then, the working fluid is smoothly supplied to each heating chamber 4.

In a printer head according to the conventional art, when particles are introduced into a channel for supplying working fluid for heating chambers or a defect is generated during the etching of the channel so that a pathway of the working fluid is obstructed, the working fluid can not move to the heating chambers, resulting in failure of the working fluid to fill the heating chamber. In such a case, the membranes can not operate normally.

In the printer head according to the present invention, however, even though the first channel 30 is partially obstructed by means of dust or particles or due to a defect in the etching of the channel, the heating chambers 4 fill with the working fluid as the working fluid moves through the second channel 20 toward the heating chambers 4. Therefore, the membranes can be smoothly operated. As a result, printing by the device of the present invention is markedly improved compared to a conventional printhead with such an obstruction.

It is preferable to form the first and second channels 30 and 20 with the same width as each other. The second channel 20 for supplying the working fluid for the heating chambers as well as the first channel 30 are effectively used as main pathways.

Figure 2:
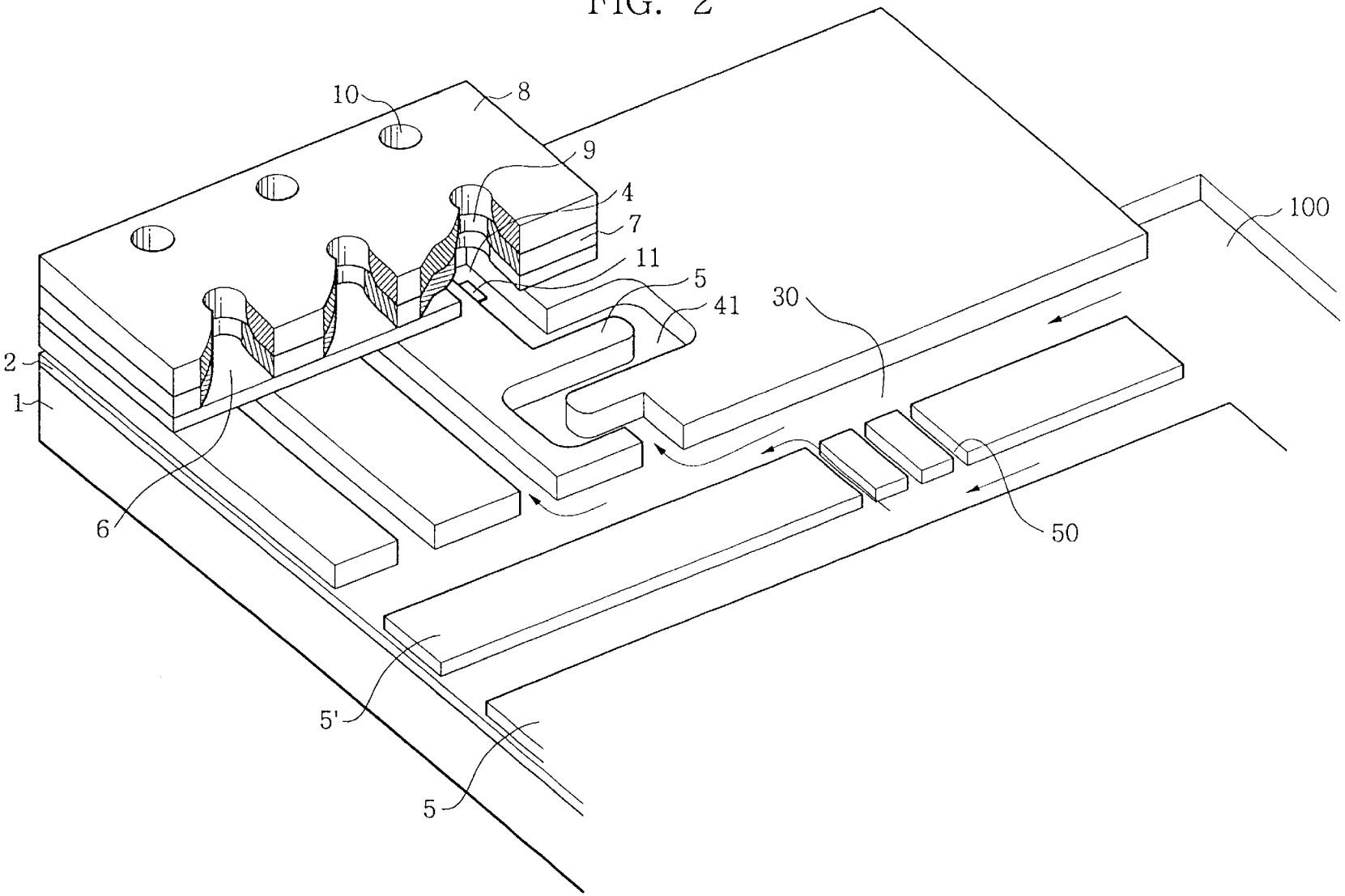
FIG. 2 is a perspective view of a channel array of an ink-jet printer head for supplying working fluid for heating chambers according to the second embodiment of the present invention.

As shown in FIG. 2, according to one embodiment of the present invention, the third channel 41 for supplying the working fluid for the heating chambers has a curved shape in order to increase flow resistance of the working fluid. Since the working fluid comes in close contact with the heating chamber barrier layer 5 leading to a generally increased flow resistance, the working fluid does not roll back to the adjacent heating chambers when to be introduced into the heating chambers 4. Each heating chamber 4 which is connected to the third channel 41 can hold the predetermined quantity of the working fluid therein without back up of the fluid.

In a printer head without a curved third channel, the heating layer heats the working fluid which is filled in the heating chamber so as to raise the pressure in the heating chamber, but this results in backwash of the working fluid to the adjacent heating chambers. Therefore, the heating chambers are unevenly supplied with the working fluid. As the result, the membranes operated improperly. This can degrade the quality of printing.

As described above, however, as the third channels 41 for supplying the working fluid for the heating chambers have the curved shape so as to increase the fluid resistance of the working fluid, a large surface of the heating chamber barrier layer 5 can come into contact with the working fluid. Accordingly, the third channels cause the working fluid which is introduced into the heating chambers 4 not to easily back up to the adjacent heating chambers. The heating chambers 4 respectively contain always the predetermined quantity of the working fluid. This makes the membranes operate accurately, resulting in improved printing.

Preferably, the third channels 41 have an S shape in the plane of the heating chamber barrier layer. In this case, since the heating chamber barrier layer 5 has a rounded surface, the working fluid has a small amount of friction against the surface of the heating chamber barrier layer 5 to be smoothly supplied in the heating chambers 4.

Figure 3:
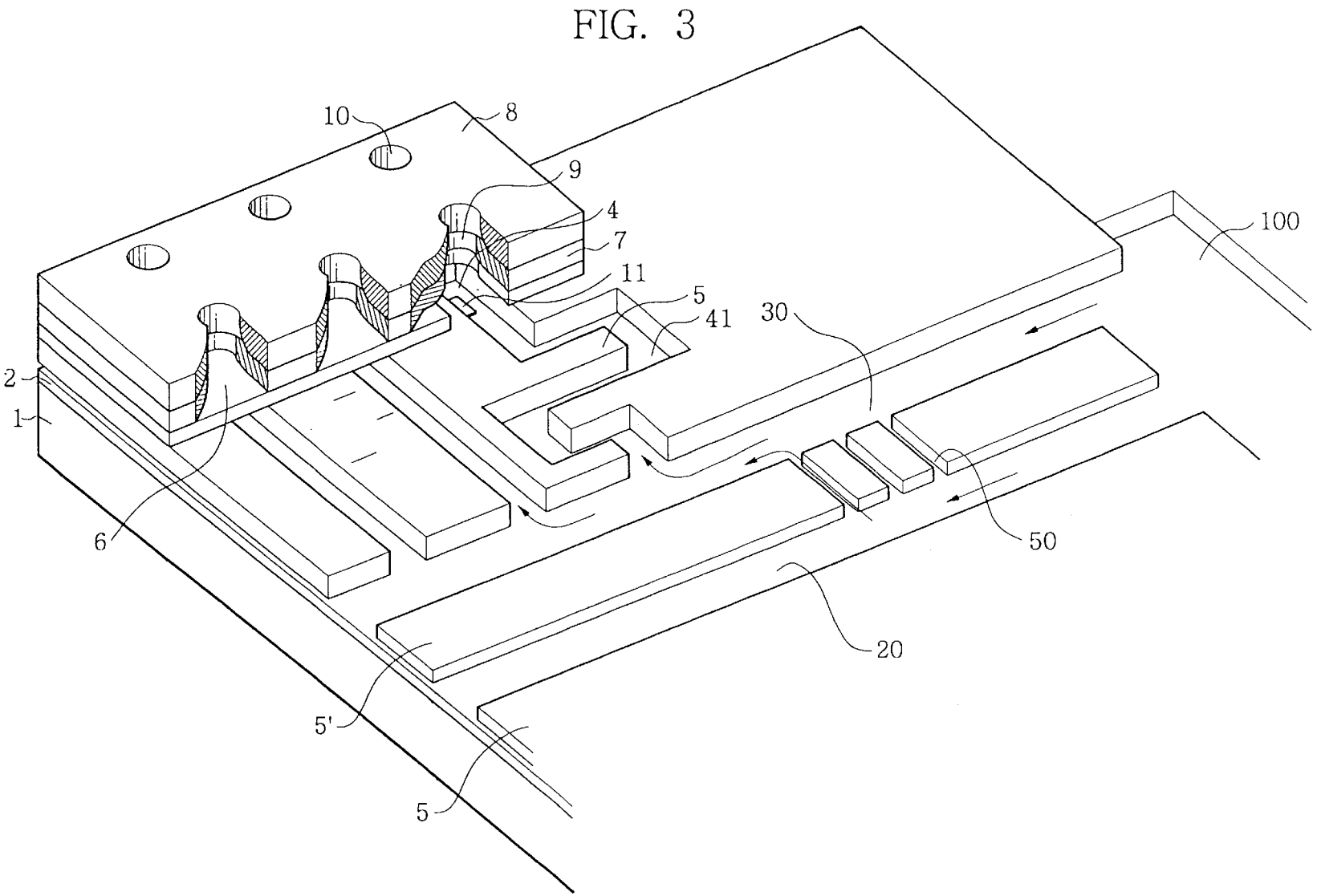
FIG. 3 is a perspective view of a channel array of an ink-jet printer head for supplying working fluid for heating chambers according to the third embodiment of the present invention.

On the other hand, as shown in FIG. 3, in a third embodiment, the third channels 41 may have a L-shape in the plane of the heater chamber barrier layer. In this case, the heating chamber barrier layer has a wall with angled corners. This causes the fluid resistance of the working fluid against the wall of the heating chamber barrier layer to be maximized, while it can be possible to prevent effectively the working fluid which is contained in the heating chamber from backing up.

The S- or L-shaped channels may be selectively applied in manufacture of the printer head according to the desired characteristics of the printer head. As described above, in any case of applying the S- or L-shaped third channel to the printer head, the third channels 41 for supplying the working fluid for the heating chambers communicate with both of the first channel 30 and the second channel 20 which are used for supplying the working fluid for the heating chambers. Even though any of these channels is obstructed, the working fluid may be moved through the rest of the channels. Therefore, the working fluid fills the heating chambers, allowing accurate operation of the membranes. As the result, it is possible to markedly improve the printing.

Figure 4:
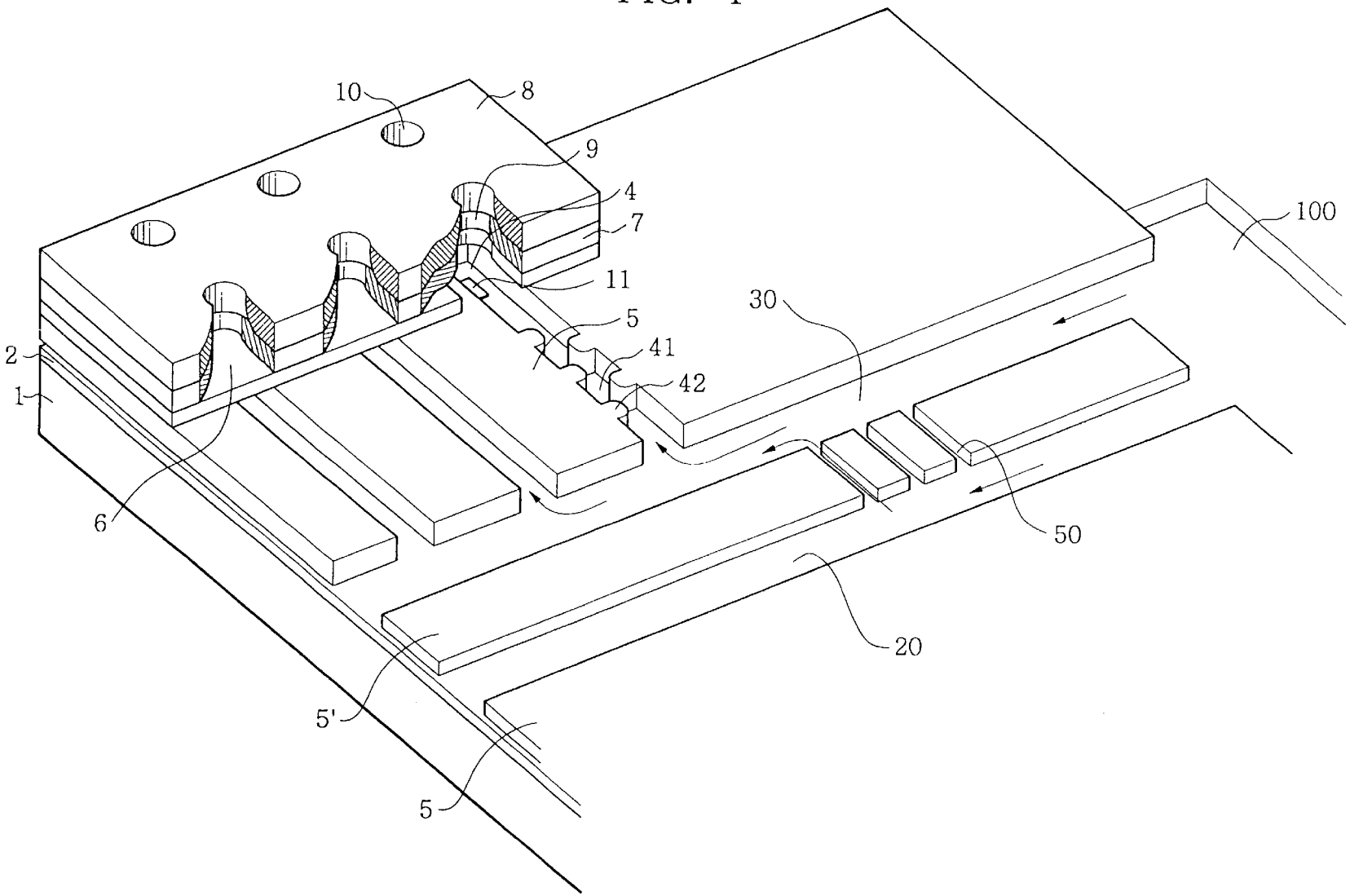
FIG. 4 is a perspective view of a channel array of an ink-jet printer head for supplying working fluid for heating chambers according to the fourth embodiment of the present invention.

As shown in FIG. 4, according to another embodiment of the present invention, a plurality of projections 42 are formed on an outer wall of a heating chamber barrier layer to increase the fluid resistance of the working fluid, which defines the third channels 41 for supplying the working fluid for the heating chambers. Since the working fluid comes into contact with the projections 42 so that the general fluid resistance of the working fluid is increased, the working fluid can not back up to the adjacent heating chambers even if the pressure in the heating chambers is raised after the working fluid is introduced into each of the heating chamber. Each heating chamber 4 which is connected to the third channel 41 can hold the predetermined quantity of the working fluid therein without back up. This makes the membranes 6 operate accurately, resulting in improving the printing.

Preferably, the projections 42 have a semi-circular shape in the plane of the heating chamber barrier layer. The working fluid can not be fictionized against the projections 42 having a curved surface while being smoothly supplied for each of the heating chamber 4.

Preferably, the projections 42 are formed to be opposite to each other. Therefore, the projections 42 maximize the prevention of backwash. More preferably, the projections 42 may be formed to be alternated with, or staggered to, each other. In this case, the pathway for the working fluid is long. Accordingly, the projections 42 can also provide maximum prevention of the backwash, similarly to where the projections are formed to be opposite to each other.

Figure 5:
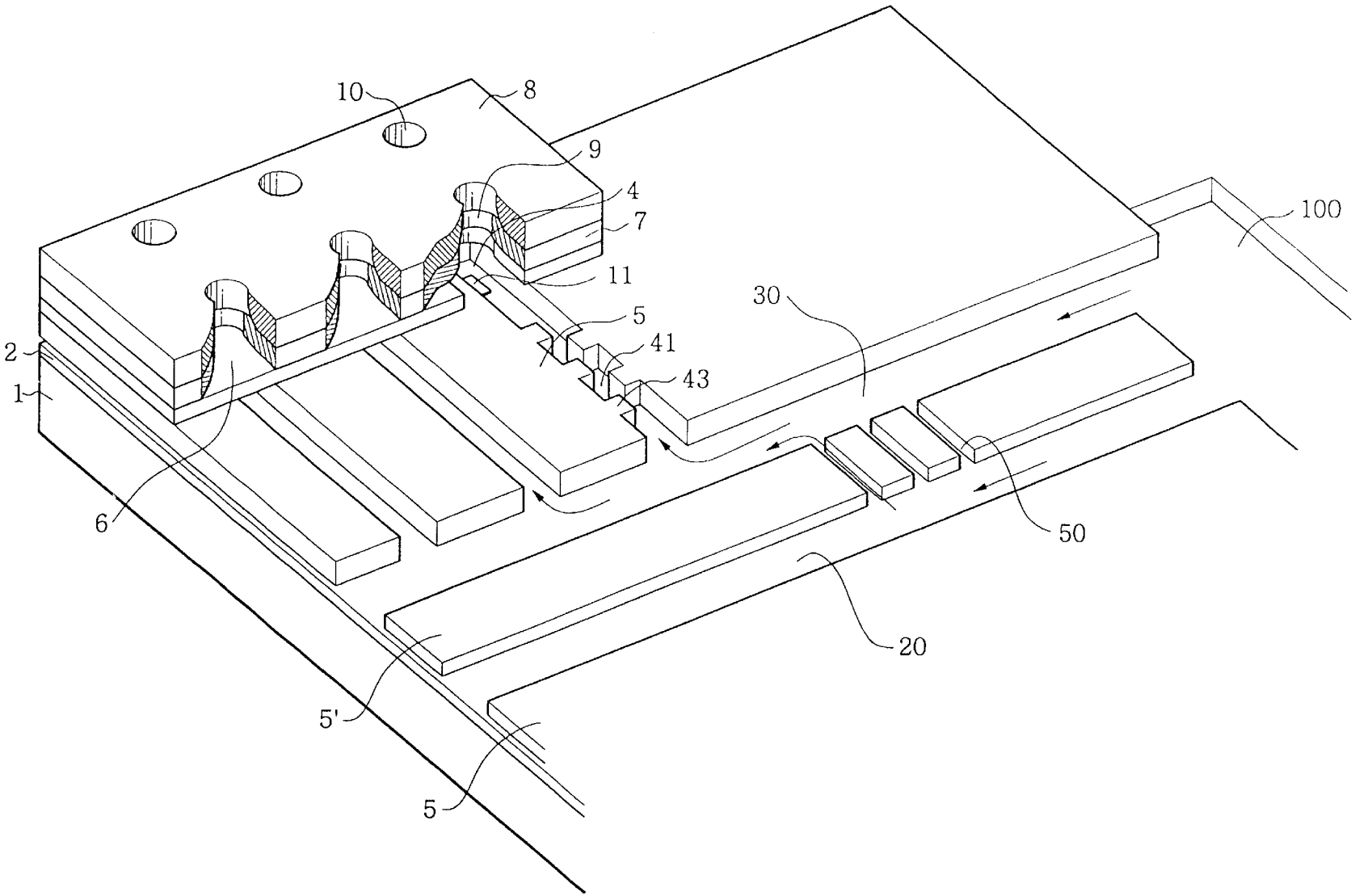
FIG. 5 is a perspective view of a channel array of an ink-jet printer head for supplying working fluid for heating chambers according to the fifth embodiment of the present invention.

As shown in FIG. 5, the projections 43 may have a quadrangular shape in the plane of the heating chamber barrier layer. Since the projections 43 are distinguished from the projections having the semi-circular shape by having four corners, the quadrangular projections 43 can effectively prevent the backwash of the working fluid which fills each of the heating chamber 4.

The shape of the projections, such as the semi-circular shape 42 or the quadrangle shape 43 can be chosen in accordance with the manufacturing condition of the printer head. In each case, as described above, the third channels 41 for supplying the working fluid for each heating chamber 4 communicate with the first channel 30 and the second channel 20. Therefore, even if one of the first and second channels 30 and 20 is obstructed, the working fluid can be moved through the other channel 30 or 20. Accordingly, the heating chambers 4 are continuously filled with the working fluid. This results in smooth operation of the membranes 6. As the result, the printing can be improved.

Figure 6:
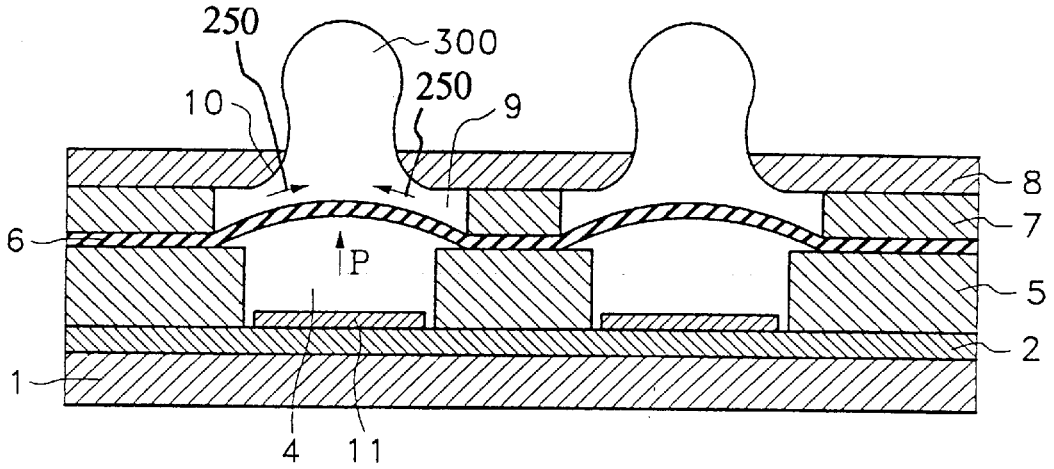
FIG. 6 is an illustrative cross-sectional view of an ink-jet printer head to which the channel array of the present invention for supplying the working fluid for heating chambers is applied, which shows the first operating state of the ink-jet printer head.

Hereinafter, the operation of the ink-jet printer head to which the channel array according to the present invention described above will be described. Referring first to FIG. 6, when electric energy is applied to an electrode layer from an external electric source, the heating layer 11 which is connected to the electrode layer is supplied with the electric energy. At this time, the heating layer 11 is instantly heated to a high temperature of about 500° C. Thus, the electric energy is transformed into 500~550° C. of heat energy.

Then, the heat energy s transmitted to the heating chamber 4 connected to the heating layer 11, while the working fluid filling the heating chamber 4 is rapidly vaporized by the heat energy so as to generate a predetermined pressure. This vapor pressure is transmitted toward the membrane 6 which is disposed on the surface of the barrier layer 5, thereby applying a predetermined impact force P to the membrane 6.

Membrane 6 is rapidly expanded outward and bent as indicated by arrows 250. Accordingly, an impact force is applied to ink 300 which fills the ink chamber 9 defined on the membrane 6 so that the ink 300 begins to be ejected from the device.

As described above, the third channels 41 according to the present invention prevent the working fluid which is supplied for the heating chamber 4 from backing up to the adjacent heating chamber 4. Thereby, the membrane 6 can be expanded smoothly. In the present invention, furthermore, since a stoppage of the flow of the working fluid can be already prevented by the first and second channels 30 and 20, the heating chamber 4 contains the predetermined quantity of the working fluid, thereby preventing the membrane from stopping operation.

Figure 7:
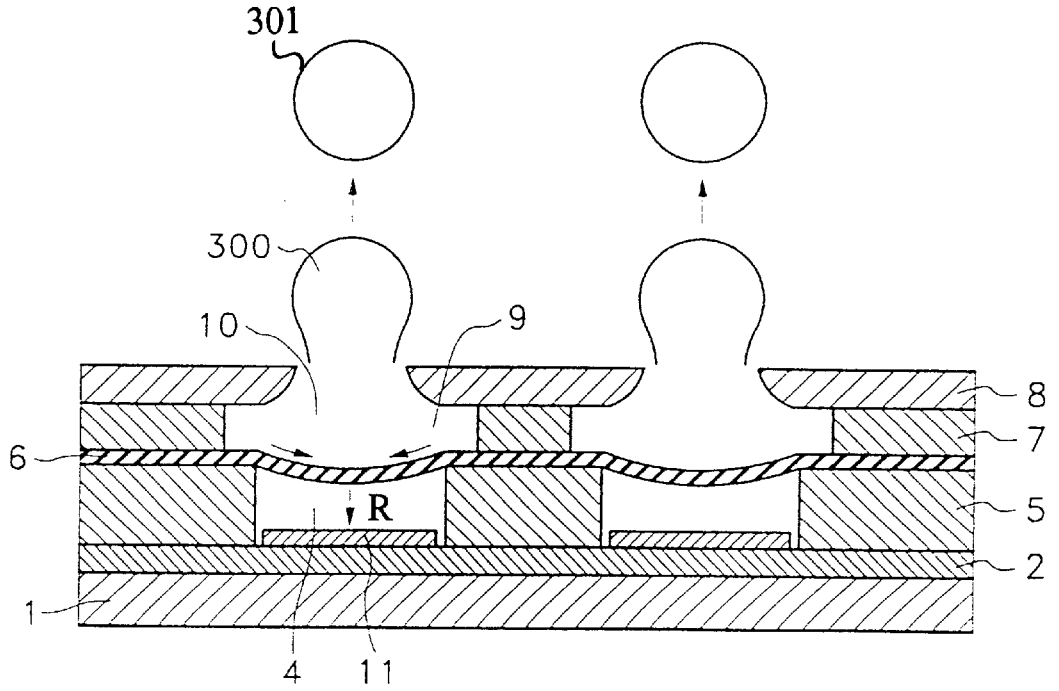
FIG. 7 is an illustrative cross-sectional view of an ink-jet printer head to which the channel array of the present invention for supplying the working fluid for heating chambers is applied, which shows the second operating state of the ink-jet printer head.

As shown in FIG. 7, when the electric energy is no longer supplied to the heating layer 11 from the external electric source, the heating layer 11 rapidly cools and the vapor pressure in the heating chamber 4 is decreased. Then, the heating chamber 4 is in a low pressure state. Due to this low pressure state, the membrane 6 is subjected to a reaction force R corresponding to an impact force, and in turn is contracted so as to return to a original position.

At this point, the membrane 6 rapidly contracts to transmit the reaction force toward the heating layer 11, as indicated by arrow R. Accordingly, the ink 300 which is in the state of being injected due to the expansion of the membrane 6 is deformed by the ink's own weight into a drop 301 and is then injected on a paper for printing. The paper is printed with drops of the ink injected from the printer head.

According to the present invention, two main channels for supplying the working fluid for the heating chambers are provided for the working fluid to flow smoothly through the main channels. As the result, it is possible to prevent a stoppage in the operation of the membrane.

With reference to the present invention, furthermore, the feeder channels are formed to be bent or have projections are formed on the outer surface of the barrier layer which defines the feeder channels, so as to prevent the rolling back of the working fluid. Thus, the membrane can be accurately operated and the quality of the printing is improved.

While the present invention has been particularly shown and described with reference to the ink-jet printer head, it will be understood that the micro injecting device of the present invention can be applied to a micro pump of a medical appliance or a fuel injector.

In the printer head for ink-jet printer having a channel array according to the present invention, as described above, the two main channels for supplying the working fluid for the heating chamber are formed in the printer head. When one of the main channels is obstructed by dust or particles or due to the defect of the etching, the working fluid can be moved through the other channel which is connected with the one channel so that it is possible to prevent a loss in the supply of the working fluid.

Also, the feeder channels for supplying the working fluid for the heating chambers are formed to be bent or the projections are formed on the outer surface of the barrier layer which defines the feeder channels in the printer head, so as to increase markedly the fluid resistance of the working fluid. Feeder channels which are curved or have projections formed thereon cause the working fluid to be prevented from backing up to the adjacent heating chambers. As the result, the membrane can be accurately operated.

While the present invention has been particularly shown and described with reference to a particular embodiment thereof, it will be understood by those skilled in the art that various changes in form and detail may be effected therein without departing from the scope of the invention as defined by the appended claims.

What is claimed is:

1. A micro-injecting device, comprising:

a base;

a protective film disposed on the base;

a heating resistor disposed on a portion of the protective film, for heating a heating chamber;

an electrode layer disposed on the protective film and contacting the heating layer, for providing electricity from an external source to the heating layer;

a heating chamber barrier layer disposed on the electrode layer, said heating chamber barrier layer defining said heating chamber surrounding the heating resistor;

a channel array formed in the heating chamber barrier layer, said channel array comprising:

a feeder channel connected to the heating chamber, for supplying a working fluid to the heating chamber;

a primary channel connected to the feeder channel, for supplying the working fluid to the feeder channel;

an auxiliary channel disposed adjacent to the primary channel;

an inlet channel connected to the primary channel and the auxiliary channel, for introducing the working fluid to the primary and auxiliary channels; and a cross-channel connecting the primary channel to the auxiliary channel;

a membrane layer overlaying the heating chamber barrier layer, for transmitting the volume change of the working fluid upon heating of the working fluid;

a liquid chamber barrier layer disposed on the membrane, said liquid chamber barrier layer defining a liquid chamber coaxial with the heating chamber; and a nozzle plate disposed on the liquid chamber barrier layer, said nozzle plate having a nozzle aligned with the liquid chamber, for forming a drop from an injection liquid in the liquid chamber.

2. The micro-injecting device of claim 1, said primary channel having the same width as said auxiliary channel.

3. The micro-injecting device of claim 1, further comprising a plurality of cross-channels connecting the primary channel to the auxiliary channel.

4. The micro-injecting device of claim 1, further comprising:

a plurality of heating chambers formed in the heating chamber barrier layer; and a plurality of feeder channels each connecting a heating chamber to said primary channel.

5. The micro-injecting device of claim 1, said feeder channel having a meander between said heating chamber and said primary channel, for increasing the flow resistance of the working fluid.

6. The micro-injecting device of claim 1, said feeder channel having a curved shape in the plane of the heating chamber barrier layer, for increasing the flow resistance of the working fluid.

7. The micro-injecting device of claim 6, said feeder channel being S-shaped in the plane of the heating chamber barrier layer.

8. The micro-injecting device of claim 1, said feeder channel having L-shaped turns in the plane of the heating chamber barrier layer, for increasing the flow resistance of the working fluid.

9. The micro-injecting device of claim 1, further comprising:

projections formed in the heating chamber barrier layer on a wall of the feeder channel and projecting into the feeder channel, for increasing the flow resistance of the working fluid.

10. The micro-injecting device of claim 9, said projections being formed on both walls of the feeder channel.

11. The micro-injecting device of claim 10, the projections on one wall of the feeder channel being formed opposite the projections on the other wall of the feeder channel.

12. The micro-injecting device of claim 11, said projections being semi-circular in shape in the plane of the heating chamber barrier layer.

13. The micro-injecting device of claim 11, said projections having a quadrangle shape in the plane of the heating chamber barrier layer.

14. The micro-injecting device of claim 10, the projections on one wall of the feeder channel being formed staggered with the projections on the other wall of the feeder channel.

15. The micro-injecting device of claim 14, said projections being semi-circular in shape in the plane of the heating chamber barrier layer.

16. The micro-injecting device of claim 14, said projections having a quadrangle shape in the plane of the heating chamber barrier layer.

17. The micro-injecting device of claim 9, said projections being semi-circular in shape in the plane of the heating chamber barrier layer.

18. The micro-injecting device of claim 9, said projections having a quadrangle shape in the plane of the heating chamber barrier layer.

19. The micro-injecting device of claim 1, further comprising:

ink in said liquid chamber.

20. The micro-injecting device of claim 1, said working fluid being heptane.

* * * * *

UNITED STATES PATENT AND TRADEMARK OFFICE

CERTIFICATE OF CORRECTION

PATENT NO. : 6,270,198 B1
DATED : August 7, 2001
INVENTOR(S) : Ahn et al.

It is certified that error appears in the above-identified patent and that said Letters Patent is hereby corrected as shown below:

Title page,
Item [75] -- Chetrovich -- should read -- Petrovich --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*